US012235070B1

(12) United States Patent
Nachefski et al.

(10) Patent No.: US 12,235,070 B1
(45) Date of Patent: Feb. 25, 2025

(54) EFFICIENT HIGH-VELOCITY COMPRESSED-GAS-POWERED GUN

(71) Applicants: William S Nachefski, Katy, TX (US); Charles D Kownacki, Erie, PA (US)

(72) Inventors: William S Nachefski, Katy, TX (US); Charles D Kownacki, Erie, PA (US)

( * ) Notice: Subject to any disclaimer, the term of this patent is extended or adjusted under 35 U.S.C. 154(b) by 0 days.

(21) Appl. No.: 18/117,345

(22) Filed: Mar. 3, 2023

Related U.S. Application Data

(60) Provisional application No. 63/316,228, filed on Mar. 3, 2022.

(51) Int. Cl.
*F41B 11/721* (2013.01)
*F41B 11/55* (2013.01)
*F41B 11/62* (2013.01)

(52) U.S. Cl.
CPC ..... *F41B 11/721* (2013.01); *F41B 11/55* (2013.01); *F41B 11/62* (2013.01)

(58) Field of Classification Search
CPC ..... F41B 11/55; F41B 11/62; F41B 11/721
See application file for complete search history.

(56) References Cited

U.S. PATENT DOCUMENTS

| | | | | |
|---|---|---|---|---|
| 4,468,875 | A * | 9/1984 | Harrison | F41A 9/76 D22/108 |
| 7,937,870 | B2 * | 5/2011 | Brown | F41C 23/16 42/16 |
| 9,664,465 | B1 * | 5/2017 | Viviano | F41A 15/16 |
| 9,739,564 | B2 * | 8/2017 | Nachefski | F41B 11/62 |
| 10,113,829 | B2 * | 10/2018 | Nachefski | F41A 19/10 |
| 10,371,473 | B1 * | 8/2019 | Wei | F41A 9/76 |
| 2002/0020402 | A1 * | 2/2002 | Kotsiopoulos | F41B 11/71 124/76 |
| 2011/0253119 | A1 * | 10/2011 | Cho | F41B 11/54 124/41.1 |
| 2012/0144712 | A1 * | 6/2012 | Rostocil | F42B 14/064 42/59 |
| 2021/0285736 | A1 * | 9/2021 | Underwood | F41A 3/66 |

* cited by examiner

*Primary Examiner* — Bret Hayes
(74) *Attorney, Agent, or Firm* — Richard K Thomson

(57) ABSTRACT

A gas-powered gun features an action bolt with a probe carrier assembly utilized to load a pellet into the rifle-barrel chamber and a striker that is released when the trigger is pulled which contacts a valve stem allowing high-pressure gas to expel the pellet and initiate blowback of the probe carrier assembly which, in turn, draws the striker rearward to fire the next round. A magazine is used in conjunction to present successive pellets from a continuous conveyor belt made up of pivotably interconnected chambers.

5 Claims, 10 Drawing Sheets

EFFICIENT HIGH-VELOCITY COMPRESSED-GAS-POWERED GUN

BACKGROUND AND SUMMARY OF THE INVENTION

The present invention is directed to the field of projectile-launching air guns. More particularly, the present invention is directed to improvements of those inventions described and claimed in U.S. Pat. Nos. 9,739,564 and 10,113,829 which are hereby incorporated by reference in their entirety.

While the rifle depicted and claimed in the two enumerated patents represents a significant improvement over existing weapons, additional improvements in functionality was deemed warranted and led to the improved features set forth herein. The specific features which are novel are the manner of operation of the improved compressed-gas-powered gun; the improved magazine; the revised bolt guide assembly; and the renovated valve configuration.

The present invention comprises an efficient, high-velocity compressed-gas-powered air gun, in which the improvement includes: an action bolt assembly positioned between an upper body and a lower body of the air gun, the action bolt assembly including a) a bolt guide; b) an action bolt which reciprocates within the bolt guide to fire a pellet from a rifle bore, the action bolt including i) a probe carrier assembly comprising a carrier body, a probe piston which can reciprocate in the carrier body, and a probe extending from the probe piston lying partially within the carrier body and extending partially therefrom, the probe carrier assembly operative in a pellet-loading sequence; ii) a striker for activating a firing sequence when released by a drop sear in response to a trigger being pulled. The invention further includes the improvement in which the bolt guide is manufactured of low friction polymer material facilitating high-speed reciprocation of the bolt guide.

Additionally, the invention includes a magazine interacting with the carrier assembly in the pellet-loading sequence, the magazine including a) a housing having a front cover and a rear cover; b) first and second hubs each having cog teeth positioned on each of their circumferential surfaces; c) a continuous conveyor belt made up of a plurality of interconnected links, each link comprising a pellet-receiving receptacle; d) a first positioning hub having teeth for securing the continuous conveyor belt in a fixed orbit; e) a second driving hub for indexing the continuous conveyor belt from a first position with a first pellet-receiving receptacle aligned with a set of concentric openings in the front and the rear covers to a second position with a second adjacent pellet-receiving receptacle aligned with the set of concentric openings. The improvement further comprises a carrier spring for biasing the probe carrier assembly to an active position in which the probe enters through the first concentric opening in the front cover and ejects a pellet contained within the first pellet-receiving receptacle from the second concentric opening in the rear cover. Additionally, the improvement further comprises a striker spring biasing the striker to an active position when the striker is released by a tine on the drop sear, a leading end of the striker depressing a catch releasing the positioning hub enabling the driving hub to initiate indexing of the conveyor belt and, proceeding through the back cover contacting a valve stem to release pressurized gas to complete the firing sequence and initiate blowback of said carrier assembly to reinitiate the loading and firing sequences.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which.

DETAILED DESCRIPTION OF THE PREFERRED EMBODIMENTS

Figure 1:
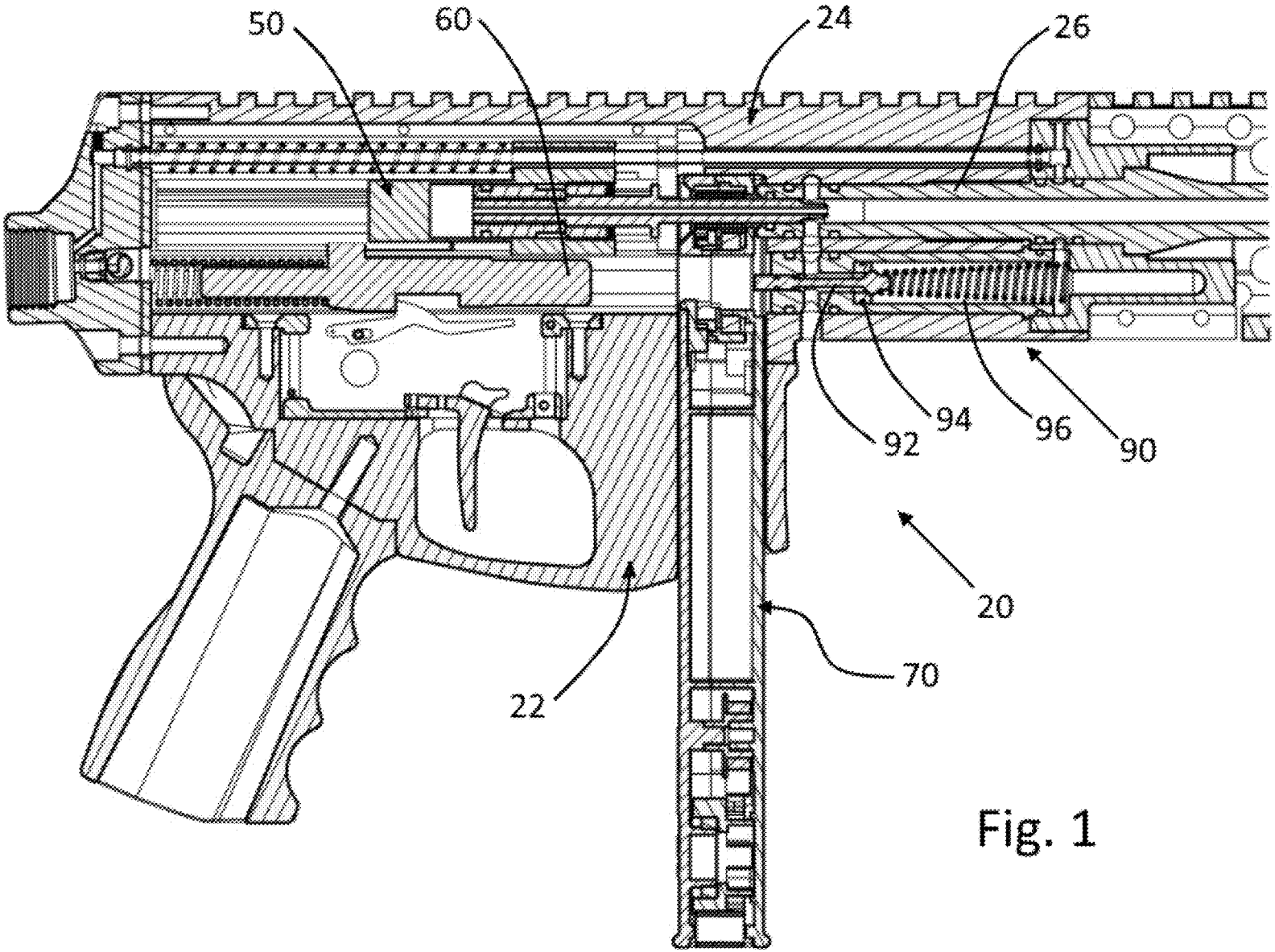
FIG. 1 is a cross-sectional side view of a first embodiment of the air gun of the present invention immediately after firing.
Figure 1A:
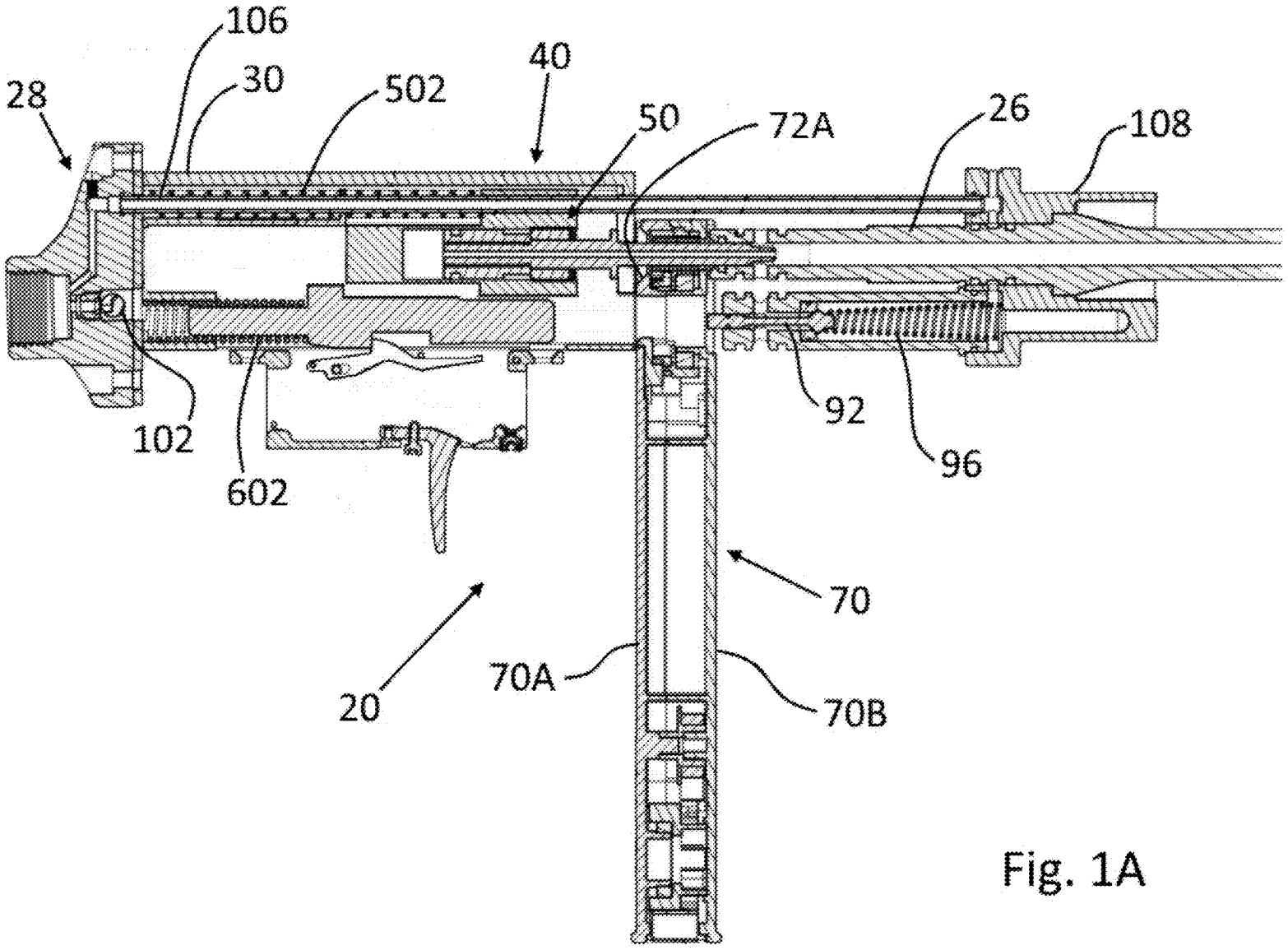
FIG. 1A is a cross-sectional side view of a first embodiment of the air gun of the present invention with the upper body and lower body assemblies removed.
Figure 1B:
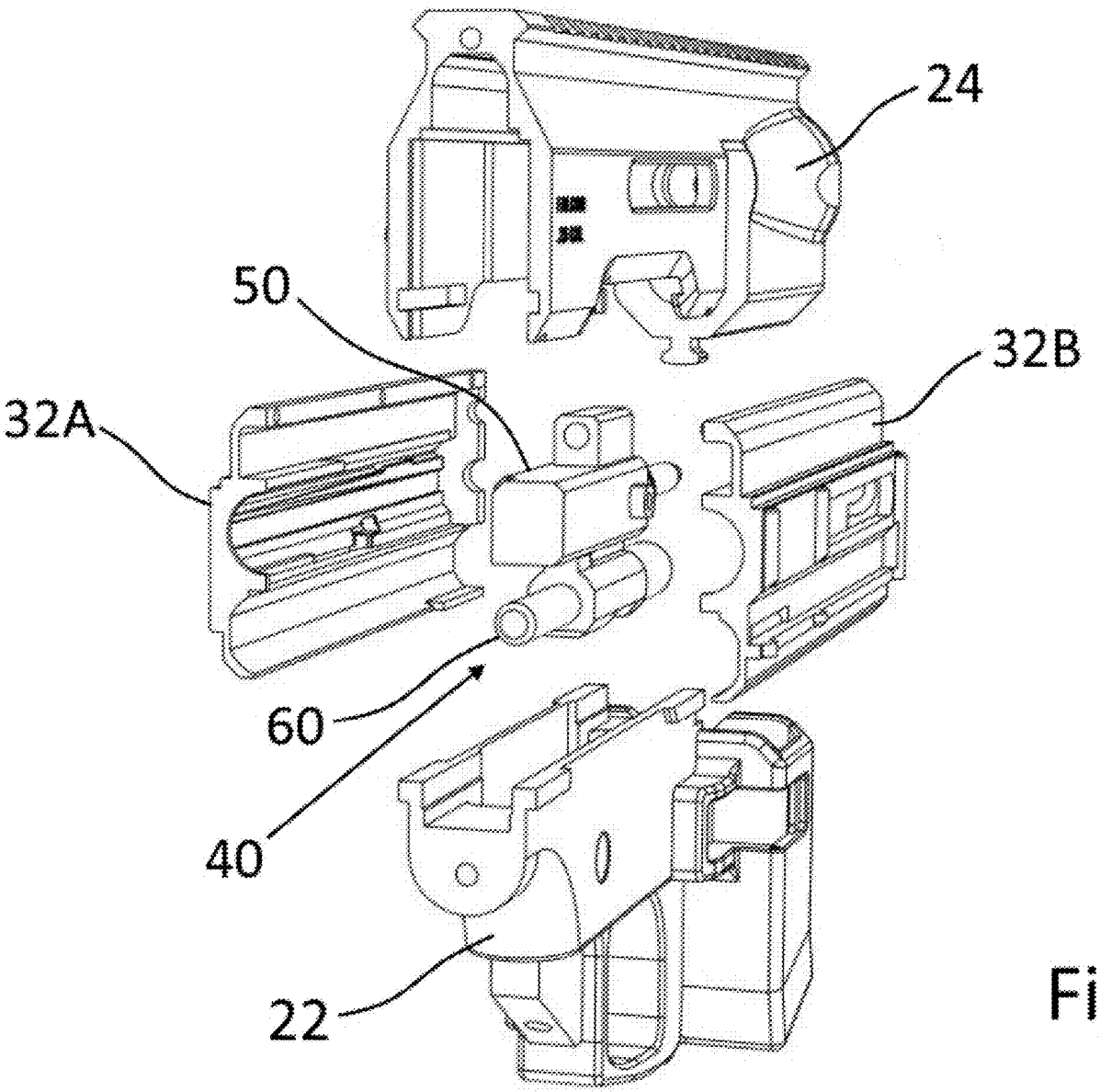
FIG. 1B is a partially exploded perspective view depicting how the bolt guide is situated in the upper receiver.

A first embodiment of the efficient, high-velocity compressed-gas-powered gun of the present invention is depicted in FIGS. 1 and 1A generally at 20. As depicted in FIG. 1B, an action bolt assembly includes two clam shell halves 32A and 32B of bolt guide 30 encapsulate the action bolt 40 made up of probe carrier assembly 50 and striker 60 and are received between upper body 24 and lower body 22. Due to the anti-friction characteristics of the polymer material from which bolt guide 30 is made, bolt guide 30 permits high-speed reciprocation of probe carrier assembly 50 and striker 60 without the need for lubricants, which can leak out onto the trigger assembly. Compressed-gas-powered gun 20 is capable of operating in either automatic or semi-automatic mode.

As shown in FIG. 1, magazine 70 is inserted through lower body 22 with the pellet loading aperture 72A (FIG. 1A) positioned adjacent and in alignment with the beginning of barrel 26. Upper body 24 is attached to lower body 22 sandwiching the bolt guide 30. Air supply valve (ASV) assembly 28 and adaptor 28A facilitate the attachment of air tank (not shown) to the rear of the gun 20. By way of example and not limitation, the air tank can be pressurized to 350 bar and ASV assembly 28 regulates/reduces the air pressure provided to the gun 20 to 2600-2800 psi. This provides a projectile speed for a 25 caliber pellet (34 grain) of around 950 feet per second (fps).

To charge the gun 20, the valve actuator 102 of ASV assembly (FIG. 1A) is rotated permitting air to charge the system by flowing through aperture 104 into air supply tube 106 into transfer block 108 where valve assembly 90 is pressurized pending firing of the weapon. Depressurization of the system is possible, without the necessity to discharge the gun, through ASV 28 by rotating the valve actuator 102 (with the tank removed) to vent the ASV to atmosphere. This affords a second safety for the weapon by venting the pressure. Valve assembly 90 includes valve stem 92, valve seat 94 and valve spring 96 which biases the valve stem 92 to the closed position.

As best seen in FIG. 1, probe carrier assembly 50 includes carrier body 52, probe 54 and probe piston 56. Air passageway 58 extends entirely through probe 54, for reasons to be detailed shortly. Carrier assembly 50 is biased to an activated position (far right, FIG. 4) by carrier spring 502. Striker 60 is biased to an activated position by striker spring 602.

Figure 6:
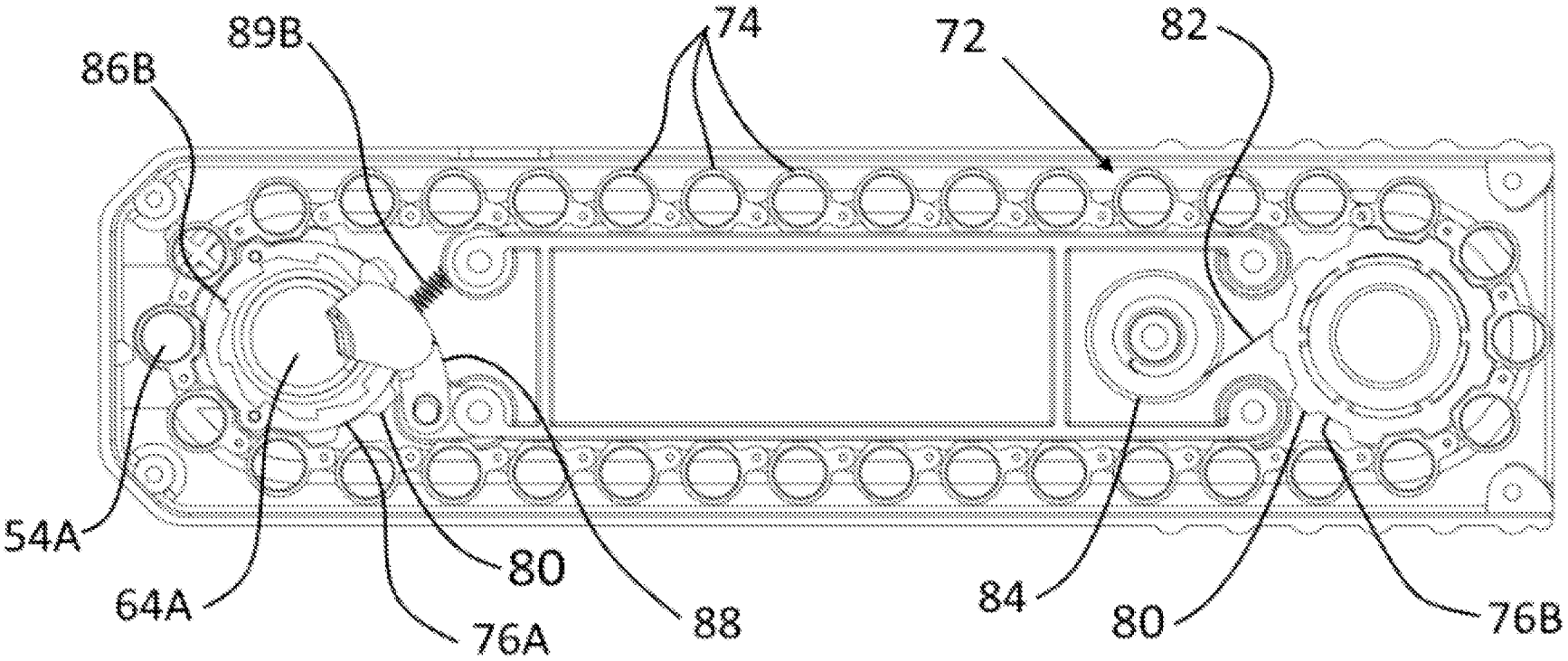
FIG. 6 is a side view with the back removed detailing the features of the magazine assembly.
Figure 7:
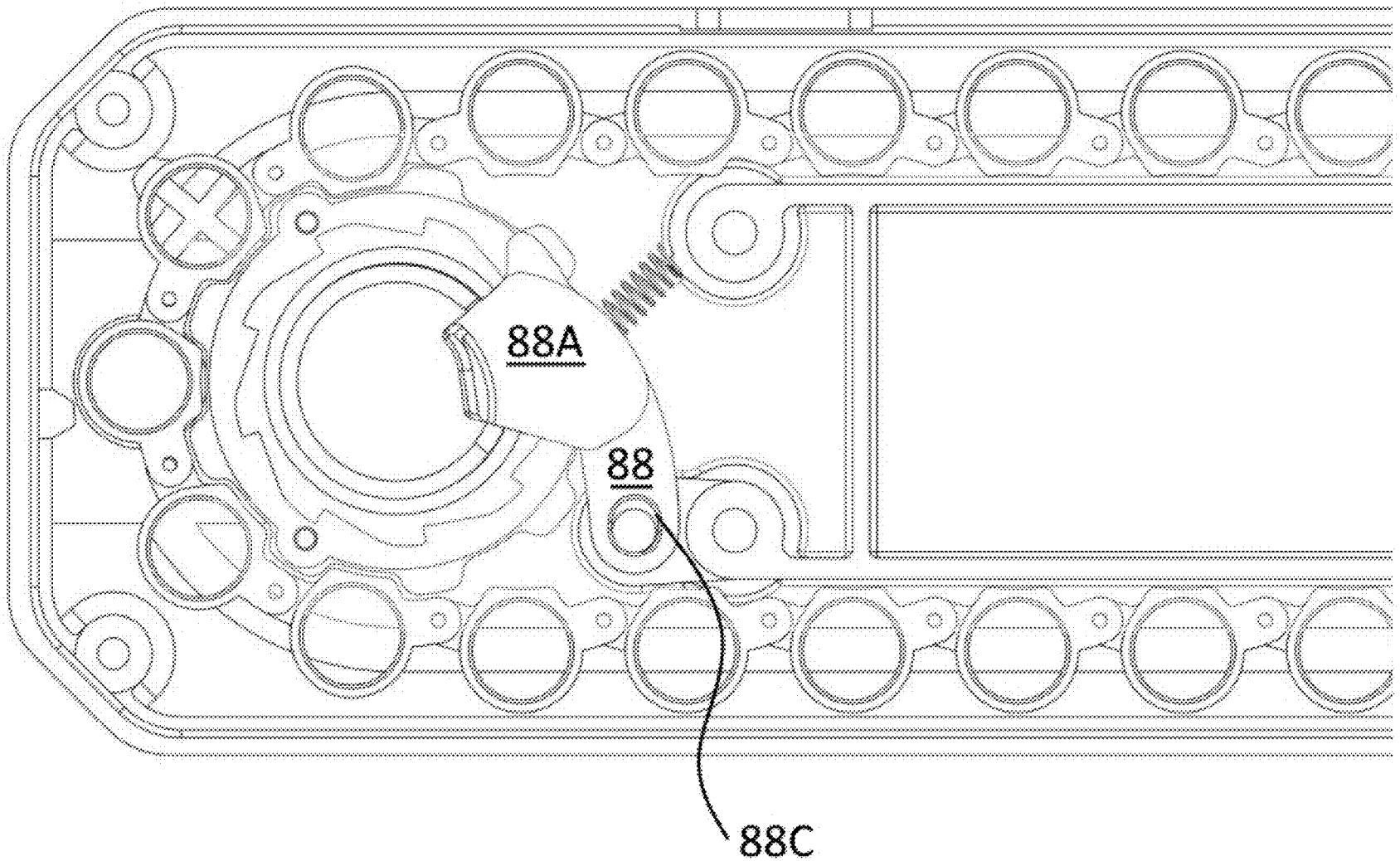
FIG. 7 is an enlarged view of the upper end of the magazine.
Figure 8:
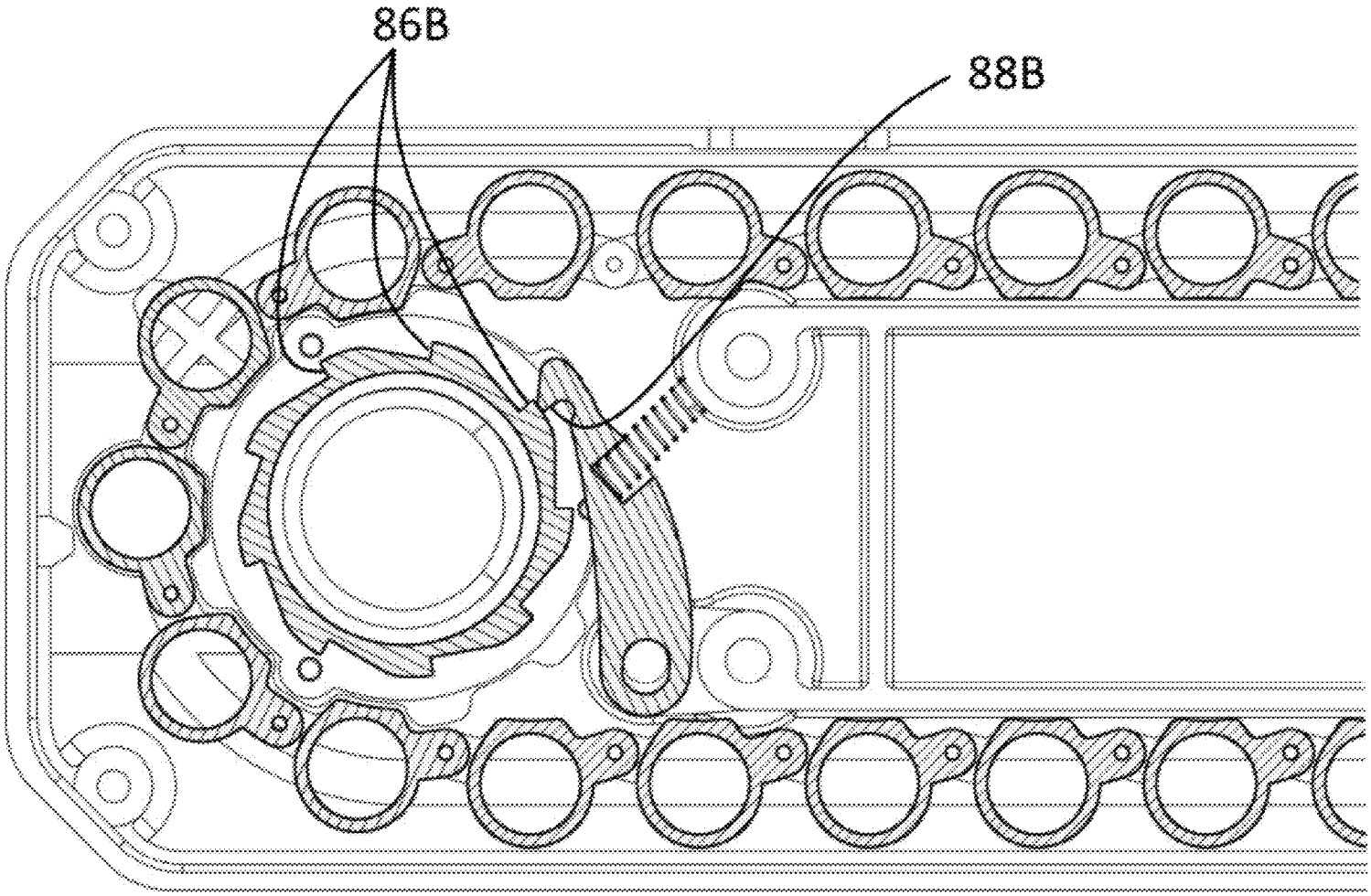
FIG. 8 is a view similar to that of FIG. 7 in partial cross section with parts removed to enhance understanding.

Magazine 70 is a key element of this invention and is shown in detail in FIGS. 6-8. Pellet conveyor belt 72 is made up of a plurality of links, each comprising a pellet-receiving receptacle 74 pivotally chained together to form a continuous belt 72 which circulates between front 70A and rear 70B surfaces of magazine 70 (FIG. 1A). Front and rear surfaces 70A and 70B have aligned openings 54A and 64A to receive probe 54 and the forward end of striker 64, respectively. Conveyor belt 72 extends around positioning hub 76A and drive hub 76B each having cogs 80 which engage between respective receptacles 74 (FIG. 6). Constant force spring 82 is on the drive hub 76B and spring 82 is coiled onto spring bobbin 84. The drum of the positioning hub 76A has a plurality of positioning teeth 86B which are engaged by tooth hook 88B on catch arm 88. Catch arm 88 has a cam 88A which is engaged to release hook 88B, pivoting catch arm 88 about pivot pin 89A against the bias of spring 89B. The opening for pivot pin 89A is a slot 88C. A little slop in the movement of the catch arm 88 is needed to facilitate disengagement of hook 88B from positioning teeth 86B. The constant force spring 82 is rewound onto the driving hub 76B from bobbin 84 by manually rotating the pellet conveyor belt 72 in the reverse (clockwise) direction to reload magazine 70, that is, insert pellets into emptied receptacles 74.

Figure 2:
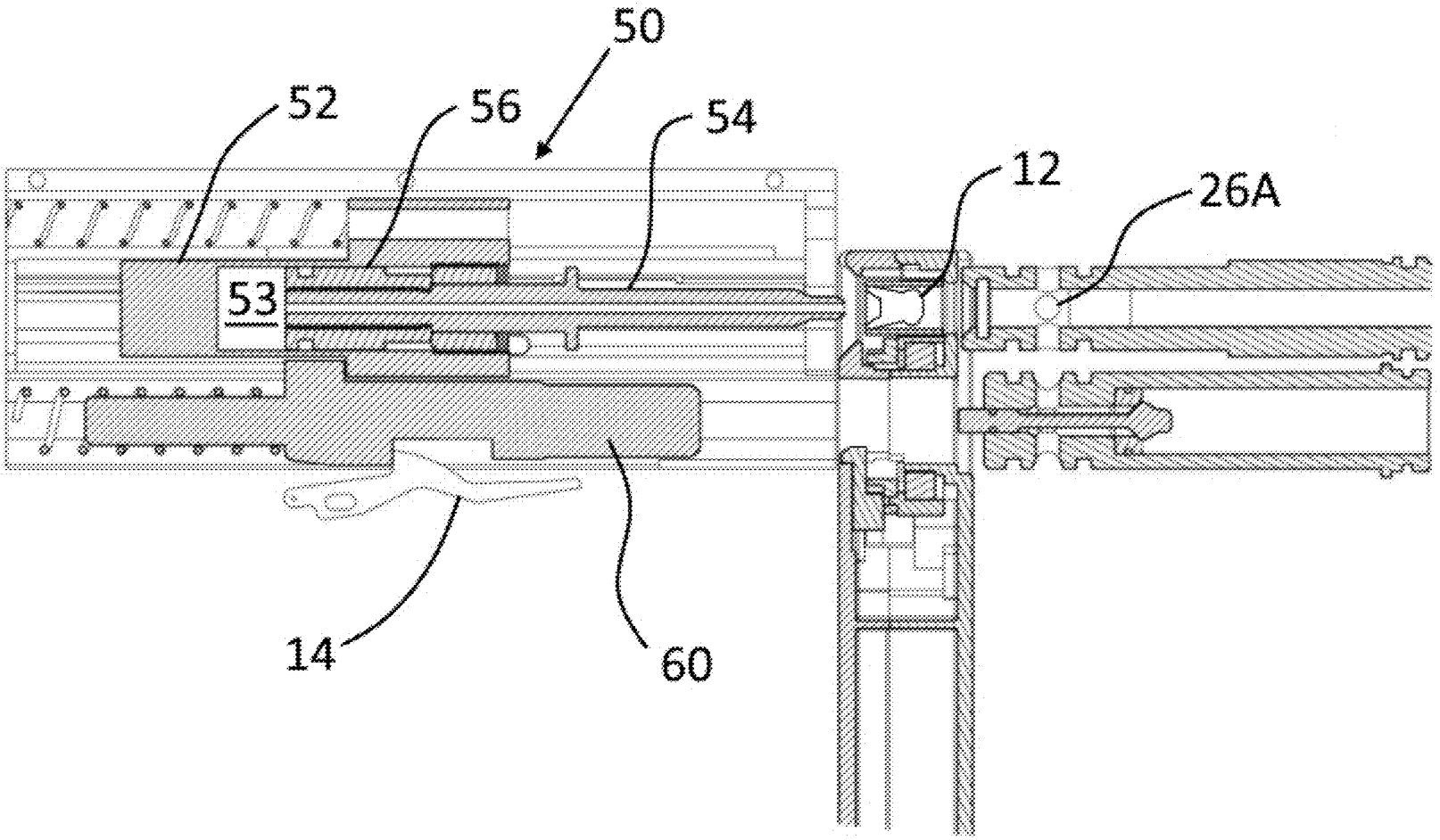
FIG. 2-5 are cross-sectional schematic side views depicting various stages of the bolt operation.

The operation of the efficient, high-velocity compressed-gas-powered gun 20 of the present invention will be described in detail in conjunction with FIGS. 2-5. FIG. 2 depicts the probe carrier 50 in motion, being biased toward and on its way to, an engaged position, by spring 502, striker 60 having been captured and restrained by drop sear 14, interrupting its forward motion energized by striker spring 602. Carrier body 52 will overtake probe piston 56 closing air gap 53 on the way to an engaged position. Probe 54 is forced forward into an engaged position forcing pellet 12 out of receptacle 74 into the barrel 26. It is crucially important that pellet be pushed passed pneumatic input port 26A as shown in FIG. 4 to ensure proper operation. The weapon is loaded and ready to fire. Note, circulation of the conveyor belt 72 to the next pellet discharging position is doubly restrained by hook 88B engaging tooth 86B and probe 54 is situated in a pellet-receiving receptacle 74 further restraining movement of conveyor belt 72.

Figure 3:
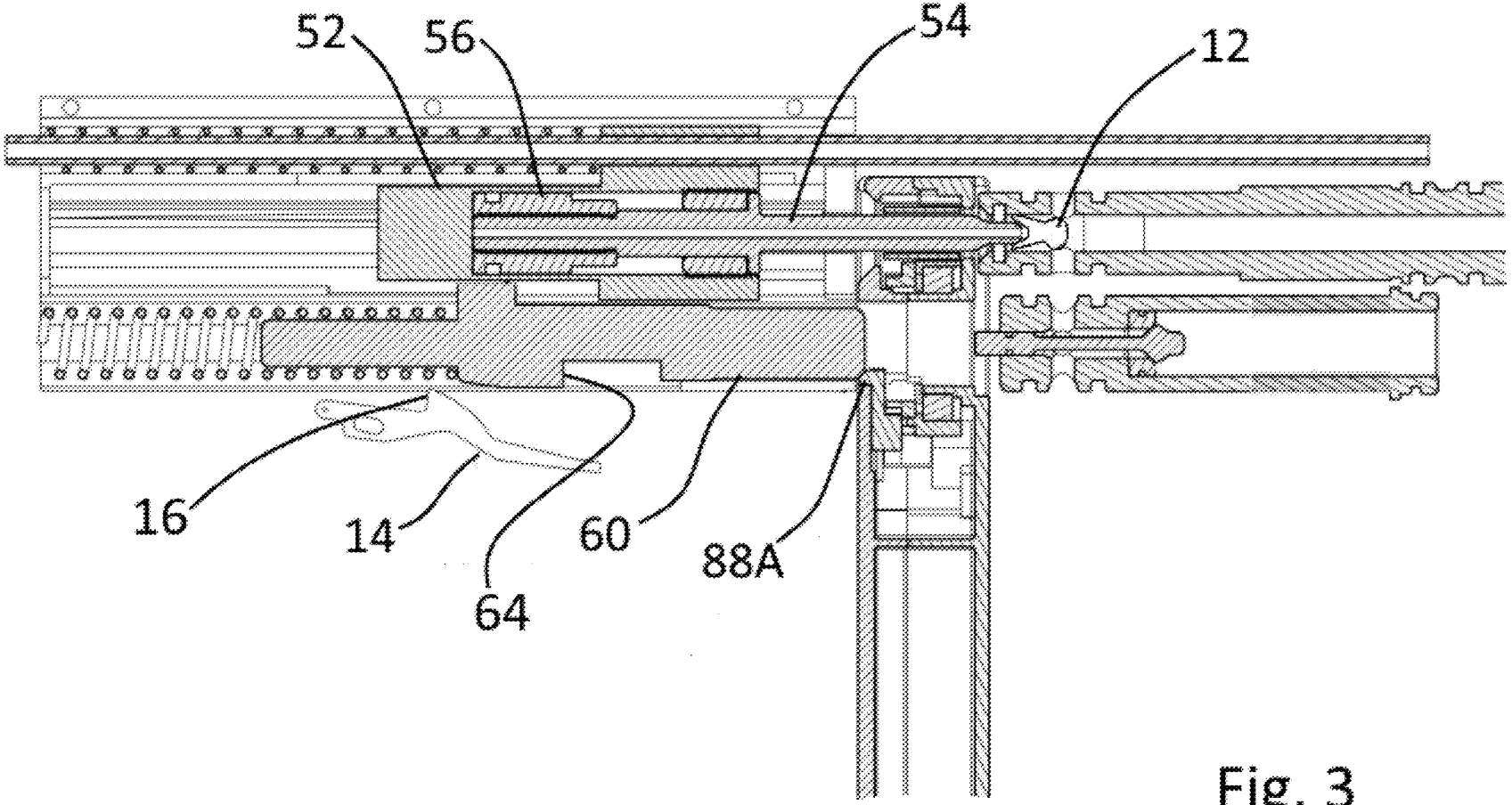
Figure 4:
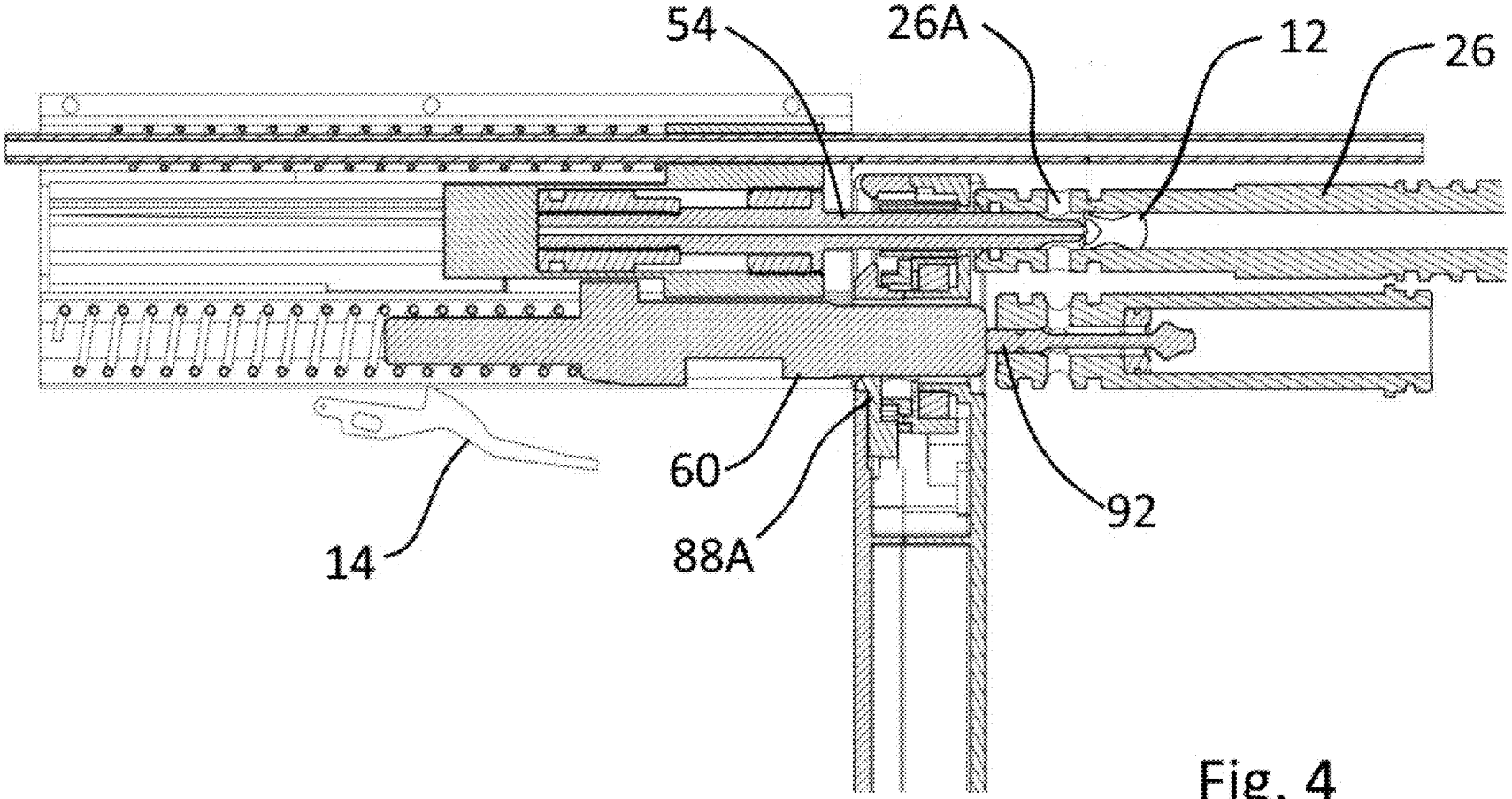

FIG. 3 depicts drop sear 14 having released striker 60 as tine 16 has been withdrawn from recess 62 in striker 60. The forward end 64 of striker 60 engages cam 88A on catch arm 88 rotating hook 88B out of engagement with positioning tooth 86B (FIG. 8) enabling conveyor belt 72 to initiate movement toward the next pellet discharge position (except for the restraint afforded by nozzle probe 54). As striker continues movement toward a fully engaged position (FIG. 4), forward end 64 contacts valve stem 92 moving it from valve seat 94 against the bias of spring 96, opening passageway 98 allowing high-pressure pneumatic fluid to pass into lateral passageway 98A and, thus, into lateral passageway 26A in barrel 26.

Figure 5:
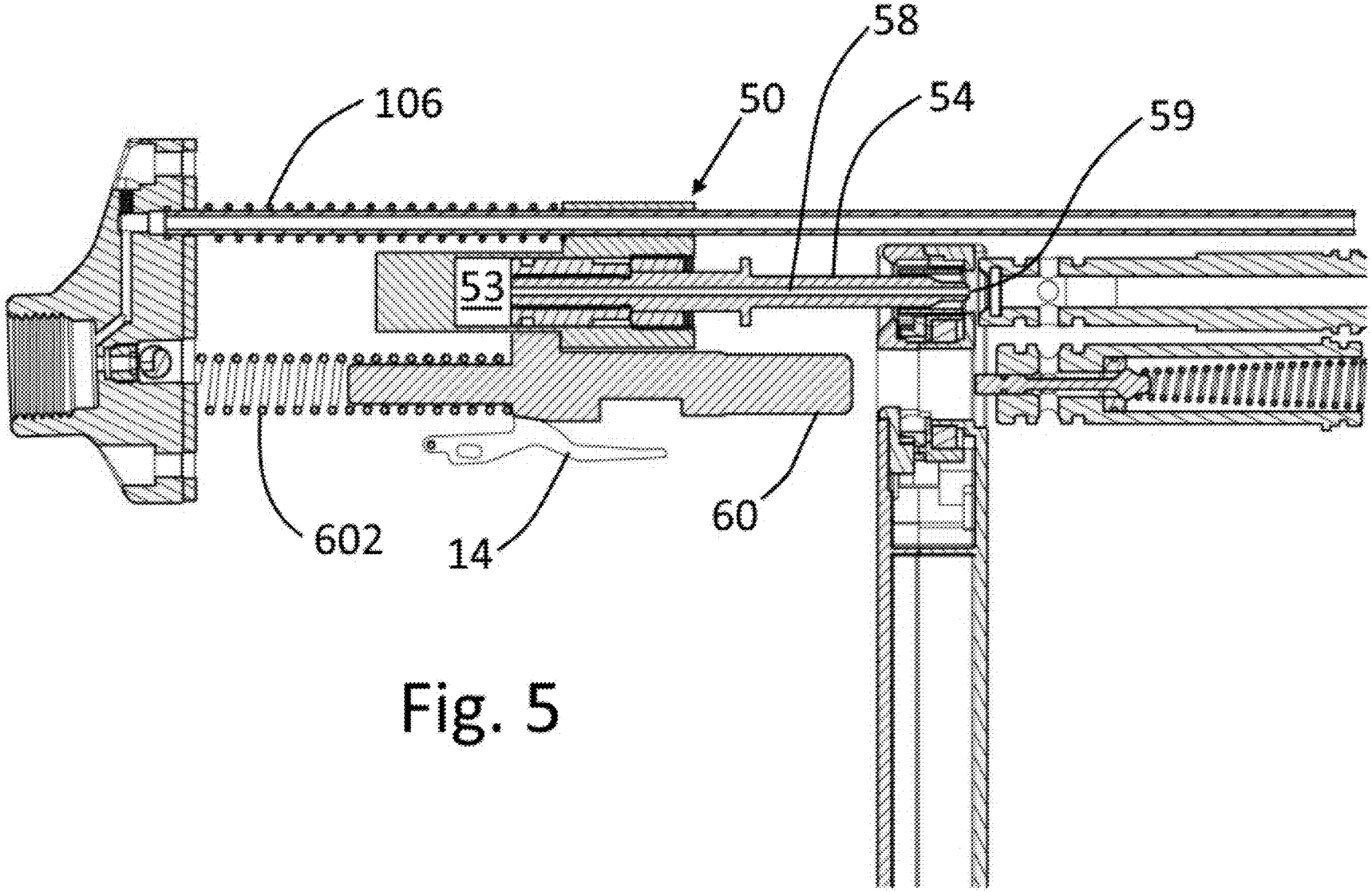

The high pressure pneumatic fluid has a duel effect: first, it propels pellet 12 from the discharge end of barrel 26 in milliseconds. Second, the pneumatic fluid initiates a "blowback" of the carrier assembly 50 and the striker 60 (FIG. 5). The high pressure pneumatic fluid enters end 59 of air passageway 58 that extends through nozzle probe 54. As shown in FIG. 5, the carrier body 52 starts moving backwards (toward the left) against the bias of spring 502 leaving the probe 54 engaged in the pellet-receiving receptacle 74 momentarily. Then, the momentum of the carrier body 52 withdraws the tip of probe 54 from the pellet-receiving receptacle 74 allowing the conveyor belt 72 to index one receptacle 74 positioning the next pellet 12 in loading position. In addition, the "hip" 55 of carrier body 52 contacts the shoulder 65 of striker 60 carrying it rearward against the bias of its spring 602. As soon as the carrier 50 and striker 60 reach their rearmost positions, the pneumatic pressure dissipates and the springs 502 and 602 initiate forward movement, with probe 54 loading the next pellet 12 into the barrel 26 and striker 60 being captured by drop sear 14 (in semi-automatic mode). This rapid action permits the gun 20 to fire rounds at the rate of 13-15 Hz. in automatic mode.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

We claim:

1. In an efficient, high-velocity compressed-gas-powered air gun, the improvement comprising a) an action bolt assembly positioned between an upper body and a lower body of said air gun, said action bolt assembly including an action bolt which reciprocates within the upper body to fire a pellet from a rifle bore, said action bolt including i) a probe carrier assembly comprising a carrier body, a probe piston which can reciprocate in said carrier body, and a probe extending from said probe piston and lying partially within said probe piston, said probe carrier assembly operative in a pellet-loading sequence;

ii) a striker for activating a firing sequence when released by a drop sear in response to a trigger being pulled;

b) a bolt guide encapsulating said action bolt, said bolt guide being manufactured of low friction polymer material facilitating reciprocation of said action bolt within and relative to said bolt guide.

2. In an efficient, high-velocity compressed-gas-powered air gun of claim 1, the improvement further comprising a magazine interacting with said carrier assembly in said pellet-loading sequence, said magazine comprising a) a housing having a front cover and a rear cover;

b) first and second hubs each having cog teeth positioned on each of their circumferential surfaces, said first hub constituting a positioning hub and said second hub constituting a driving hub;

c) a continuous conveyor belt made up of a plurality of interconnected links, each link comprising a pellet-receiving receptacle;

d) said first positioning hub having teeth for securing said continuous conveyor belt in a fixed orbit;

e) said second driving hub for indexing said continuous conveyor belt from a first position with a first pellet-receiving receptacle aligned with a set of concentric openings in said front and said rear covers to a second position with a second adjacent pellet-receiving receptacle aligned with said set of concentric openings;

f) a constant force spring including i) a ribbon spring element coiled about said drive hub, ii) a spring bobbin mounted adjacent said drive hub for receiving said coiled ribbon spring element from said drive hub and returning said coiled ribbon spring element thereto.

3. In an efficient, high-velocity compressed-gas-powered air gun of claim 2, the improvement further comprising a carrier spring for biasing said probe carrier assembly to an active position in which said probe enters through said first concentric opening in said front cover and ejects a pellet contained within said first pellet-receiving receptacle from said second concentric opening in said rear cover.

4. In an efficient, high-velocity compressed-gas-powered air gun of claim 3, the improvement further comprising a striker spring biasing said striker to an active position when said striker is released by a tine on the drop sear, a leading end of said striker depressing a catch releasing said positioning hub enabling said driving hub to initiate indexing of said conveyor belt and, proceeding through said back cover contacting a valve stem to release pressurized gas to complete the firing sequence and initiate blowback of said carrier assembly to reinitiate the loading and firing sequences.

5. A magazine for use with an efficient, high-velocity compressed-gas-powered air gun, said magazine comprising a) a housing having a front cover and a rear cover;

b) first and second hubs each having cog teeth positioned on each of their circumferential surfaces, said first hub constituting a positioning hub and said second hub constituting a driving hub;

c) a continuous conveyor belt made up of a plurality of interconnected links, each link comprising a pellet-receiving receptacle;

d) said first positioning hub having teeth for securing said continuous conveyor belt in a fixed orbit;

e) said second driving hub for indexing said continuous conveyor belt from a first position with a first pellet-receiving receptacle aligned with a set of concentric openings in said front and said rear covers to a second position with a second adjacent pellet-receiving receptacle aligned with said set of concentric openings;

f) a constant force spring including i) a ribbon spring element coiled about said drive hub, ii) a spring bobbin mounted adjacent said drive hub for receiving said coiled ribbon spring element from said drive hub and returning said coiled ribbon spring element thereto.

* * * * *